US005652997A

United States Patent [19]

Na

[11] Patent Number: 5,652,997

[45] Date of Patent: Aug. 5, 1997

[54] AUXILIARY SUCTION TOOL FOR USE IN A VACUUM CLEANER

[75] Inventor: Woon-Hee Na, Seoul, Rep. of Korea

[73] Assignee: Daewoo Electronics Co., Ltd., Seoul, Rep. of Korea

[21] Appl. No.: 515,401

[22] Filed: Aug. 15, 1995

[30] Foreign Application Priority Data

Dec. 15, 1994 [KR] Rep. of Korea ..... 94-34297

[51] Int. Cl.[6] ..... A47L 9/06

[52] U.S. Cl. ..... 15/373; 15/400

[58] Field of Search ..... 15/398, 400, 368, 15/373

[56] References Cited

U.S. PATENT DOCUMENTS

| | | | |
|---|---|---|---|
| 2,198,339 | 4/1940 | Hamilton | 15/395 |
| 2,606,338 | 8/1952 | Lorenzo | 15/395 |
| 2,811,738 | 11/1957 | Gall | 15/395 X |
| 2,948,014 | 8/1960 | Allen | 15/373 X |
| 3,320,629 | 5/1967 | Zaidan | 15/400 |
| 5,475,893 | 12/1995 | Sepke | 15/373 X |

*Primary Examiner*—Chris K. Moore

*Attorney, Agent, or Firm*—Pennie & Edmonds LLP

[57] ABSTRACT

An auxiliary suction tool for a vacuum cleaner comprises a main body having an elongated flattened tubular shape. One end of the body is connected to a vacuum cleaner hose, and the other end thereof is terminated in a flattened air intake opening. Each flat side of the body has a guide slot and a plurality of engaging aperatures. Selectively inserted into the flattened air intake opening is a pair of brush attachment frame with brushes having a fixed length on one end thereof. Each brush attachment frame has a guide member slided along the guide slot of the body and a semi-spherical projection selectively engaged with one of the aperature of the body, respectively, selectively adjusting the brush length depending on the desired cleaning purposes.

9 Claims, 4 Drawing Sheets

20
22
24
26
28a
28b
28c
30
30a
30b
32
32
34
36

AUXILIARY SUCTION TOOL FOR USE IN A VACUUM CLEANER

FIELD OF THE INVENTION

The present invention relates to an auxiliary suction tool for use in a vacuum cleaner; and, more particularly, to an auxiliary suction tool with brushes affixed to one end thereof, designed to allow an easy cleaning mode conversion and minimize brush hair loss and wear.

DESCRIPTION OF THE PRIOR ART

As is well known, a vacuum cleaner is often provided with an auxiliary suction tool attached to one end of a vacuum cleaner hose connected thereto to clean areas which are not readily accessible. In general, such an auxiliary suction tool, in the form of an elongated flattened tubular housing, is designed in such a way that one end thereof can be connected to the vacuum cleaner hose and the other end is terminated in a flattened air intake opening. The flattened end of the auxiliary suction tool is usually cut off at an angle to facilitate picking up of debris or materials from, e.g., areas adjacent to walls or corners. Further, in case of cleaning woven fabrics such as carpet, the auxiliary suction tool must be replaced with another auxiliary suction tool provided with brushes at the flattened end thereof, the brushes being used for loosening dirt or particles located deep inside the carpet. In other words, the auxiliary suction tool must be replaced in accordance with the desired cleaning purpose, inconveniencing the user. In addition, the auxiliary suction tools are usually stored within the vacuum cleaner, thereby making the vacuum cleaner unnecessarily bulky.

In this regard, there has been proposed, as shown in FIG. 1, a combination auxiliary suction tool 10 for converting from a brush attachment mode to a brushless mode, which includes a brush attachment hollow frame 14 and a body 11 with a flattened air intake opening 12 at one end thereof. The frame 14 may be inserted into or extracted from the flattened air intake opening 12 depending on the cleaning purpose. However, the frame 14 often gets lost and, furthermore, as in the previous case, the frame 14 must be inserted into or extracted from the flattened air intake opening 12, depending on the mature of the desired cleaning, making it rather cumbersome to use.

Another exemplary auxiliary suction tool is disclosed in U.S. Pat. No. 4,506,406 issued to LaMonte on Jan. 26, 1985, comprising a main body in the form of an elongated flattened tubular housing and having an opening at each end, one end being adapted to connect to a vacuum cleaner hose, and the other end terminating in a flattened air intake opening, wherein the flattened air intake opening is provided with an elongated opening with a means for selectively covering it, and a pair of elongated strip brushes extending along opposite sides of the elongated opening. Although the tool taught in the '406 patent may be useful for cleaning between crevices such as blind slats in a single unitary device and readily and instantly converting the cleaning mode without having to detach or attach the tool to the vacuum cleaner hose, the brushes thereon are always exposed regardless of whether they are needed or not, exposing them to needless hair loss or wear.

Japanese Utility Model Publication No. 93-32046 describes another auxiliary suction tool comprising a main body in the form of a tubular housing and having an opening at each end, one end being connected to the vacuum cleaner hose, and the other end terminating in a flattened air intake opening, wherein the flattened air intake opening is provided with a bridge body pivotally mounted thereon, the bridge body further including brushes affixed to one end thereof. While the tool disclosed in the Japanese Patent Publication may be useful in preventing the loss of the bridge body since it is attached physically to the tool, it still cannot prevent the hair loss from the brushes since the brushes are always exposed and the hair thereon might get lost when it comes in physical contact with furnitures or the like.

SUMMARY OF THE INVENTION

It is, therefore, an object of the present invention to provide an auxiliary suction tool provided with brushes for use in a vacuum cleaner at one end thereof, designed in such a way that it allows an easy cleaning mode conversion and prevent brush hair loss and brush wear.

In accordance with the present invention, there is provided an auxiliary suction tool for use in a vacuum cleaner, comprising:

a main body having an elongated tubular shape and being provided with an opening at each end thereof, one end being adapted to be connected to a vacuum cleaner hose and the other end terminating in an elongated flattened air intake opening with a pair of flat sides, said the other end including a pair of guide slots and a pair of sets of engaging apertures, wherein each of the guide slots and each set of the engaging apertures are located on each of the flattened sides thereof, respectively; and a pair of brush attachment frame to be inserted selectively into the flattened air intake opening of the main body, each of the brush attachment frame being provided with brushes having a fixed length at one end thereof, each of the brush attachment frame further having a guide member and a projection formed on one side thereof in such a way that the guide member in each of the brush attachment frame is to be engaged with the guide slot on one of the flattened sides and the projection in each of the brush attachment frame is to be engaged with one of the apertures from each set on each of the flattened sides to thereby adjust selectively the brush length depending on the mode of cleaning.

BRIEF DESCRIPTION OF THE DRAWINGS

The above and other objects, features and advantages of the present invention will become apparent from the following detailed description given in conjunction with the accompanying drawings, in which.

DETAILED DESCRIPTION OF THE PREFERRED EMBODIMENTS

Figure 1:
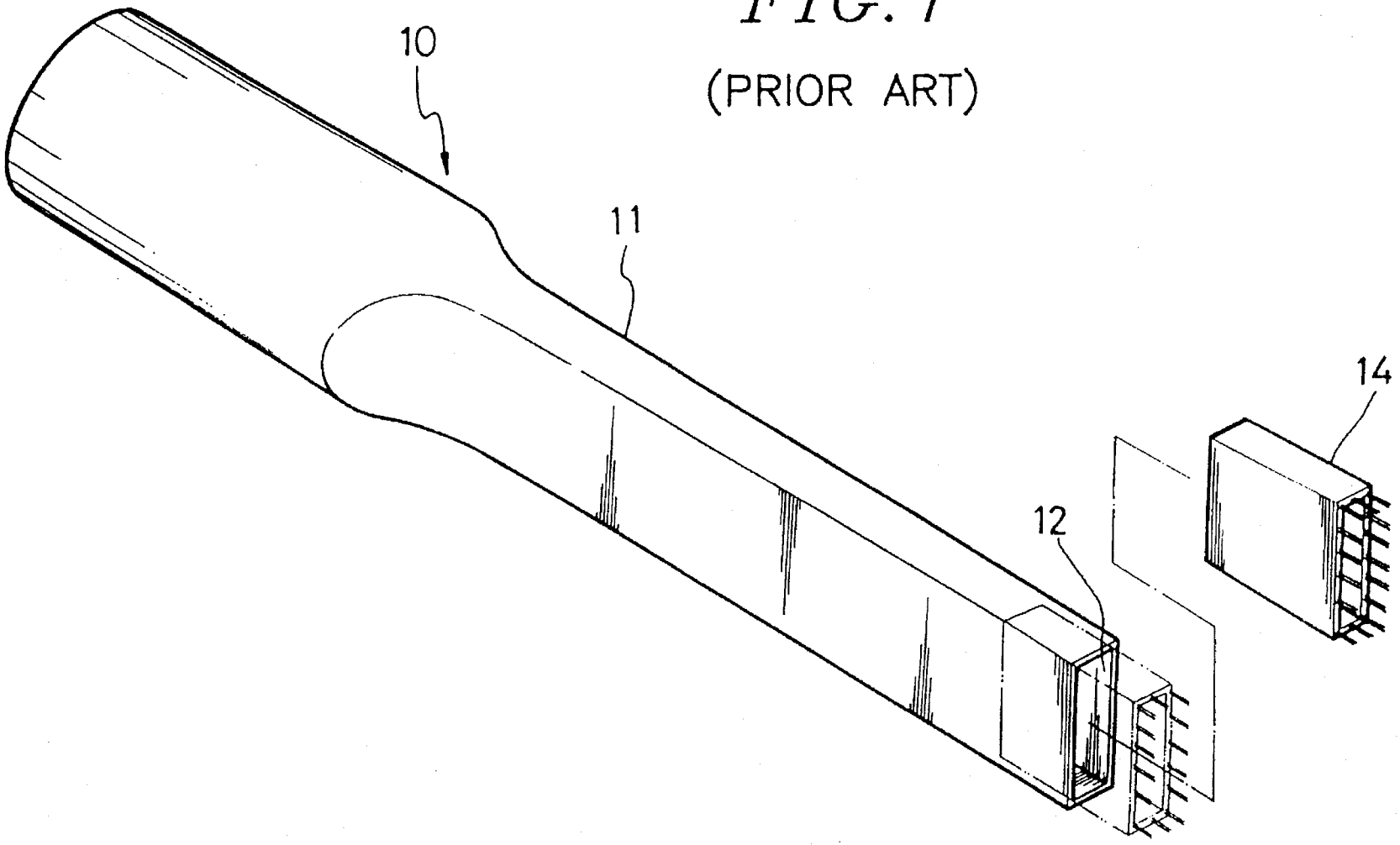
FIG. 1 (PRIOR ART)
FIG. 1 is an exploded perspective view of a prior art combination tool.
Figures 2, 2A, 2B:
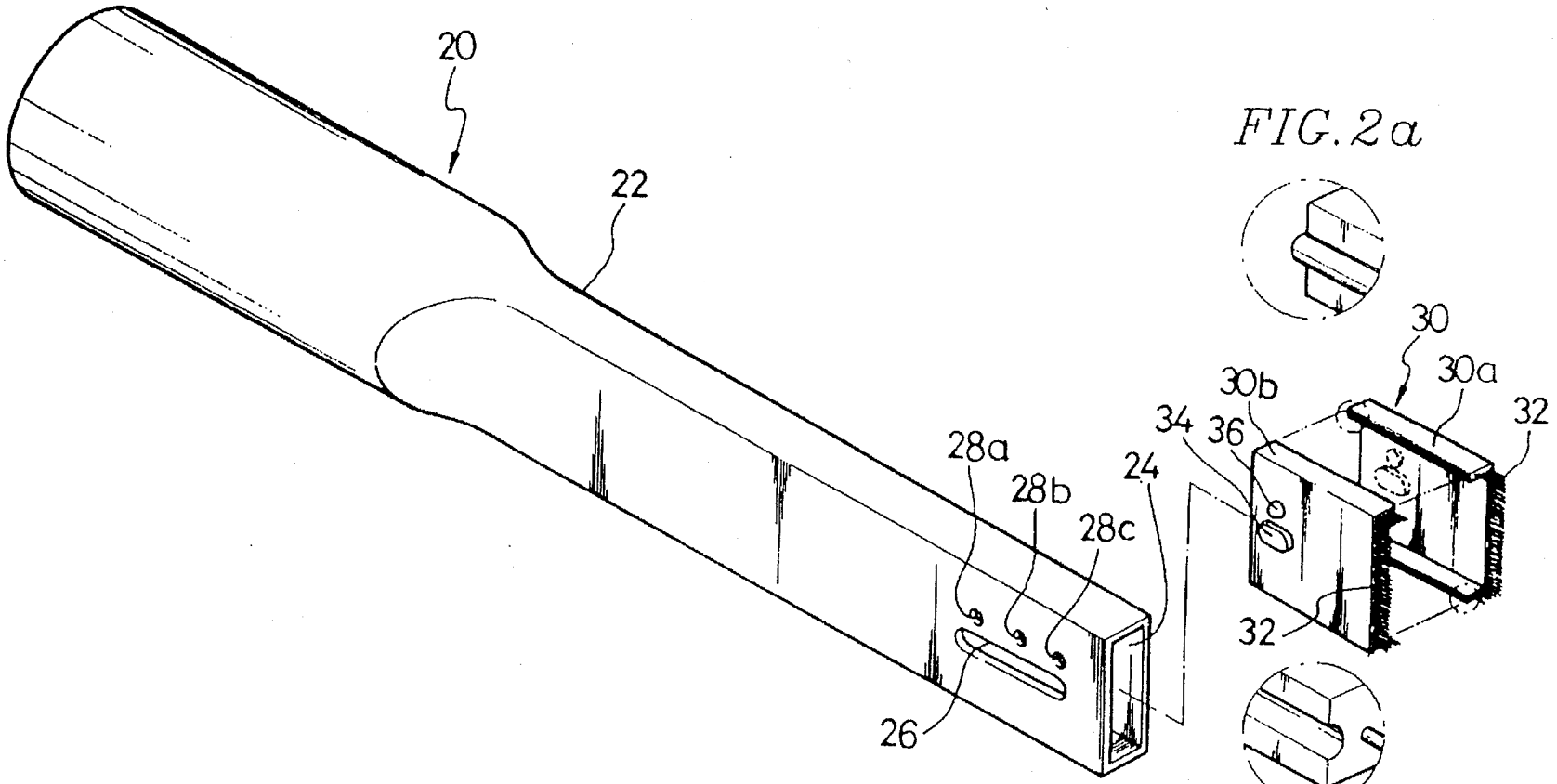
FIG. 2 is an exploded perspective view of an auxiliary suction tool in accordance with the present invention and FIGS. 2*a* and 2*b* are partial enlarged views of FIG. 2.

There is shown in FIGS. 2, 2*a* and 2*b* an inventive auxiliary suction tool for use in a vacuum cleaner. As shown, the auxiliary suction tool 20 includes a main body 22 having an elongated tubular shape and being provided with an opening at each end thereof. One end of the main body 22 is connected to a vacuum cleaner hose (not shown) and the other end thereof is terminated in an elongated flattened air intake opening 24 with a pair of flat sides. Each flat side of the body 22 is provided with a guide slot 26 and a plurality of engagement apertures 28 formed on the upper portion of the slot 26. In the preferred embodyment, the body 22 is provided with three apertures 28*a*, 28*b* and 28*c*. Further, the axiliary suction tool 20 of the present invention includes a pair of brush attachment frame 30 which are provided with brushes 32 having a fixed length on one end thereof, respectively, and engaged with each other by the structure shown in circles so as to be easily inserted into or extracted from the flattened air intake opening 24. In addition, each of brush attachment frame 30 has a guide member 34 and a semi-spherical projection 36 formed on the upper portion of the member 34. The guide member 34 may slide along the guide slot 26 and the semi-spherical projection 36 may be engaged with any one of the (apertures) 28, thereby preventing the loss of the brush attachment frame 30 and selectively adjusting the brush length depending on the desired mode of cleaning. The brush attachment frame 30 may be preferably made of a resilient material, e.g., plastic synthetic resin, capable of easily disengaging the semi-spherical projection 36 from the apertures 28.

Figures 3A, 3B, 3C:
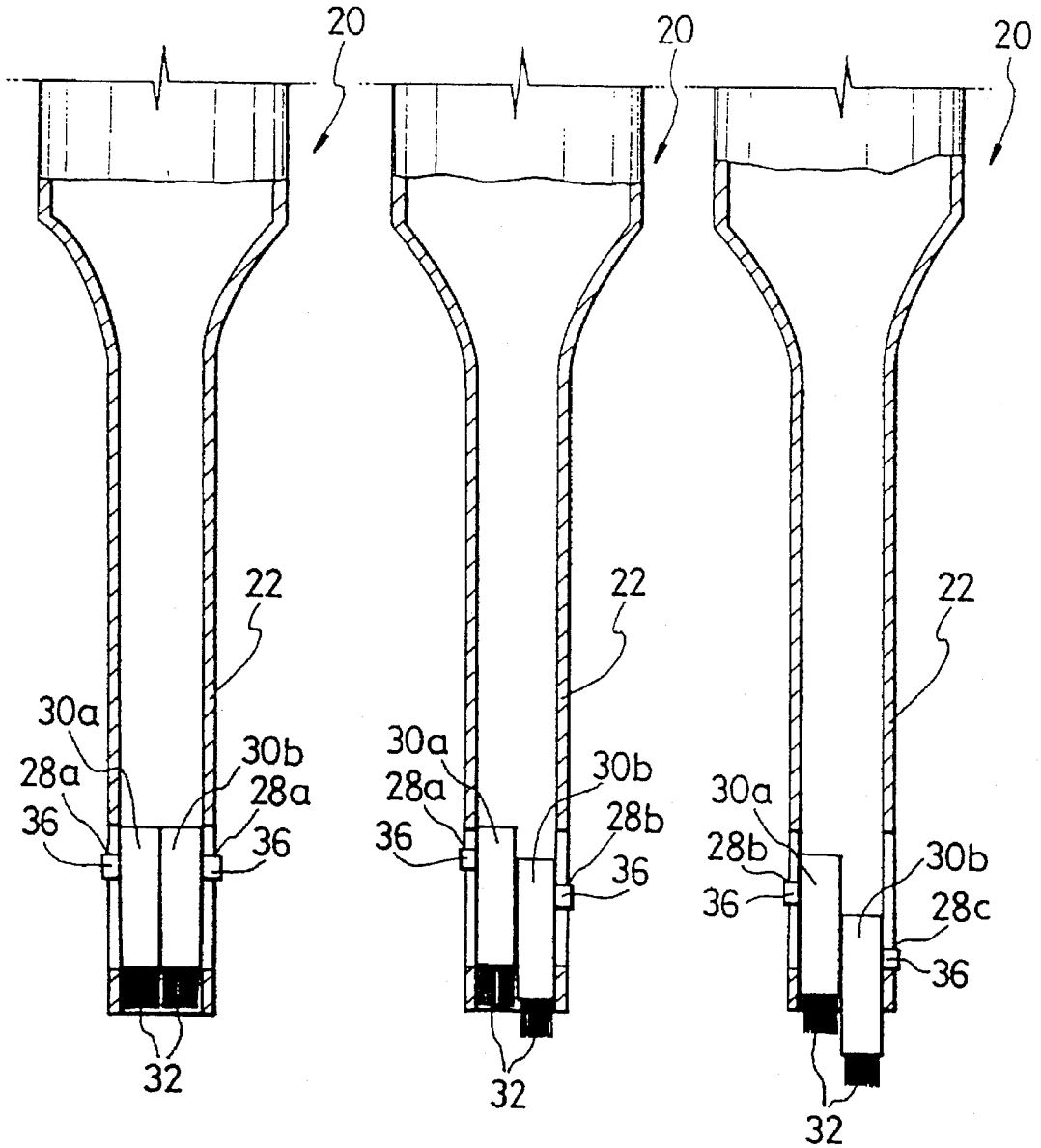
FIGS. 3A to 3E, respectively, are sectional views illustrating the selected brush length depending on the desired mode of cleaning.
Figures 3D, 3E:
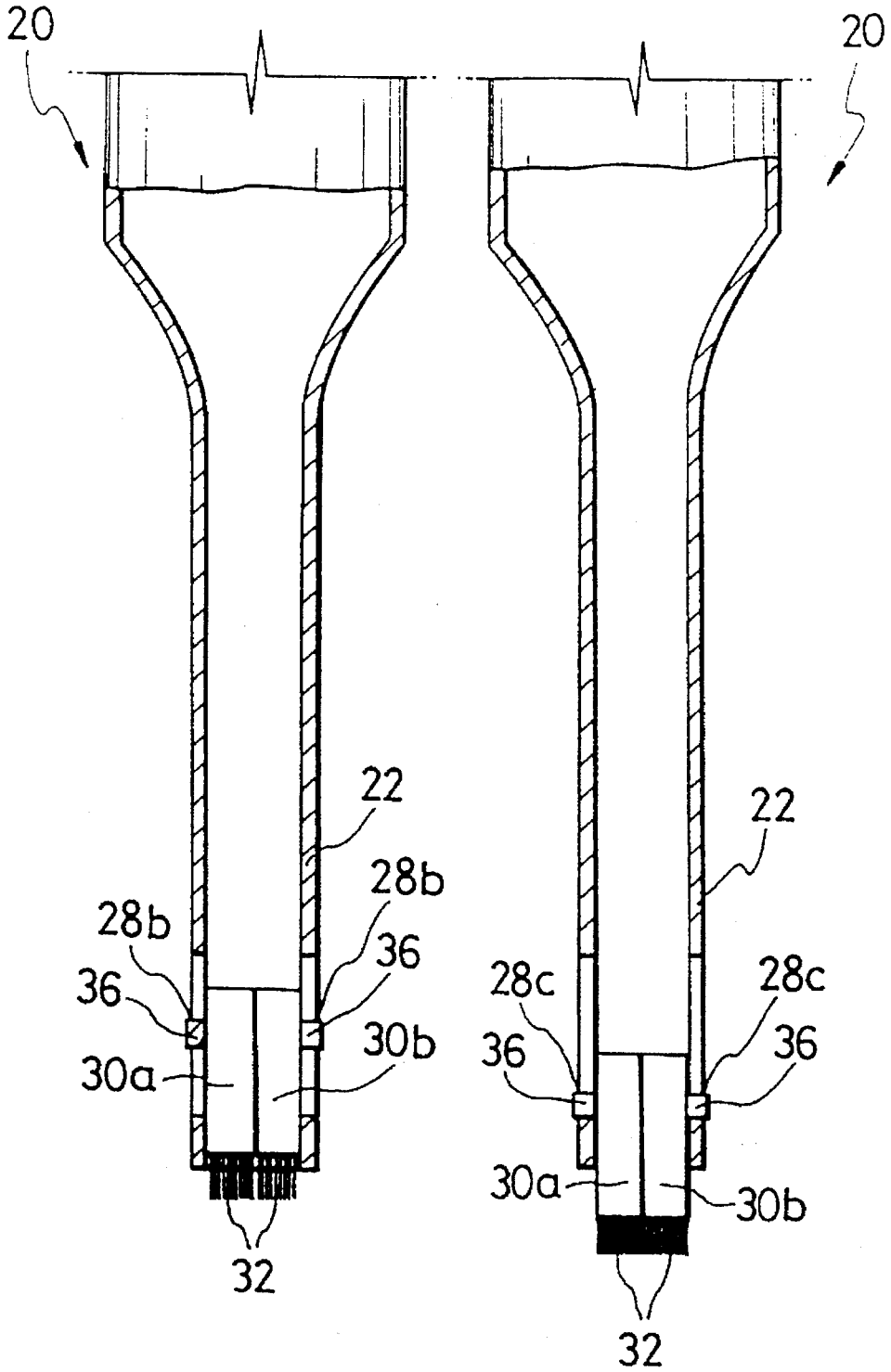

In accordance with the present invention, a pair of brush attachment frame 30 as shown in FIG. 3A is received within the main body 22 of the auxiliary suction tool 20 wherein the semi-spherical projection 36 is engaged with the first aperture 28*a*, thereby rendering the flattened air intake opening 24 of the auxiliary suction tool 20 amenable for the cleaning of soft materials. In case of using the tool 20 for the cleaning of hard subjects such as furniture, shelves, picture and so on, the projections 36 are engaged with the apertures 28*b* or 28*c* by pressurizing both of the guide members 34 so as to allow the projections 36 to be disengaged from the apertures 28*a* and then pushing them along the guide slots 26, exposing a partial or whole length of the brushes 32 from the flattened air intake opening 24, as best shown in FIGS. 3D and 3E. At this time, the brush length may be selected depending on the selected cleaning purpose.

In FIGS. 3B and 3C, it is shown that the brush length of each brush attachment frame 30 can be adaptively adjusted by engaging the projection 36 of the second brush attachment frame 30*b* with the aperture 28*b* or the projection 36 of the first brush attachment frame 30*a* with the aperture 28*b* or the projection 36 of the second brush attachment frame 30*b* with the aperture 28*c*, depending on the selected mode of cleaning.

Although the invention has been shown and described with respect to the preferred embodiments, it will be understood by those skilled in the art that certain changes and modifications may be made without departing from the spirit and scope of the invention as defined in the following claim.

What is claimed is:

1. An auxiliary suction tool for use in a vacuum cleaner, comprising:

a main body having an elongated tubular shape and being provided with an opening at each end thereof, one end being adapted to be connected to a vacuum cleaner hose and the other end terminating in an elongated flattened air intake opening with a pair of flattened sides, each of the flattened sides including a guide slot and a set of engaging apertures; and a pair of brush attachment frames inserted selectively into the flattened air intake opening of the main body, the frames having brushes of a common predetermined length on one end thereof, each of the frames further having a guide member and a projection formed on one side of each of the frames in such a way that the guide member in each of the frames is to be engaged with the guide slot of the flattened sides and the projection in each of the frames is to be engaged with one of the apertures of the flattened sides to thereby to adjust selectively the length of each of the frames extend from the elongated flattened air intake opening depending on a cleaning mode.

2. An auxiliary suction tool of claim 1 wherein each brush attachment frame has a surface, the surfaces are slideably engagable with each other.

3. An auxiliary suction tool of claim 2 wherein the surface of one frame has an elongated concave portion and the surface of the other frame has an elongated convex portion cooperating with said concave portion.

4. An auxiliary tool for use in a vacuum cleaner, comprising:

an elongated body having a first end adapted to be connected to a vacuum cleaner hose and a second end terminated in an air intake opening, the second end having at least one guide slot and a plurality of engaging apertures; and at least one brush attachment frame adapted to be slideably fitted into the air intake opening on the body, the frame having brushes of a predetermined length on one end thereof and further having a guide member and a projection formed on at least one side thereof, wherein the guide member and the projection on the frame are to be engaged with the guide slot and one of the apertures on the second end of the tubular body respectively to adjust the length of the frame extended from the air intake opening.

5. An auxiliary suction tool of claim 4 wherein there are two brush attachment frames having surfaces slideably engagable with each other.

6. An auxiliary suction tool of claim 5 wherein one frame has an elongated concave portion and the other frame has an elongated convex portion cooperating with the concave portion.

7. An auxiliary suction tool of claim 6 wherein the second end of the tubular body comprises at least one flattened wall, said wall having the guide slot and the engaging apertures disposed thereon.

8. An auxiliary suction tool of claim 7 wherein the engaging apertures comprises two to eight apertures.

9. An auxiliary suction tool of claim 7 wherein the set of engaging apertures comprises three apertures.

* * * * *